US005810907A

United States Patent [19]

Okada et al.

[11] Patent Number: 5,810,907

[45] Date of Patent: Sep. 22, 1998

[54] CONTINUOUS MELTING APPARATUS FOR LOW-MELTING POINT METAL, IMPROVED CRUCIBLE FOR SUCH APPARATUS, AND MELTING METHOD USING SUCH APPARATUS

[75] Inventors: Tamio Okada, Warabi; Hideo Yoshikawa, Yokohama; Tomohiro Hatanaka, Tokyo; Michio Matsuura, Yokohama; Toshiaki Sano, Tokyo; Masato Yoshida, Kitakyushu; Hiroshi Goda, Yokohama, all of Japan

[73] Assignee: Nippon Crucible Co., Ltd., Tokyo, Japan

[21] Appl. No.: 890,420

[22] Filed: Jul. 9, 1997

[30] Foreign Application Priority Data

| | | | |
|---|---|---|---|
| Jul. 15, 1996 | [JP] | Japan | 8-185019 |
| Nov. 19, 1996 | [JP] | Japan | 8-308087 |
| Jan. 21, 1997 | [JP] | Japan | 9-009021 |
| May 16, 1997 | [JP] | Japan | 9-127579 |
| Jun. 3, 1997 | [JP] | Japan | 9-145126 |

[51] Int. Cl.[6] ..... C22B 21/00

[52] U.S. Cl. ..... 75/687; 266/242; 266/229; 266/275

[58] Field of Search ..... 266/900, 242, 266/901, 275, 227, 228, 230, 229; 75/686, 687; 432/265

[56] References Cited

U.S. PATENT DOCUMENTS

| | | | |
|---|---|---|---|
| 152,906 | 7/1874 | Luce | 266/242 |
| 771,675 | 10/1904 | Smith | 266/242 |
| 1,707,161 | 3/1929 | Hoy | 266/242 |
| 1,931,144 | 10/1933 | Gilbert | 75/686 |
| 2,472,465 | 6/1949 | Cornell | 266/242 |

*Primary Examiner*—Scott Kastler
*Attorney, Agent, or Firm*—Barnes & Thornburg

[57] ABSTRACT

A continuous melting apparatus for a low melting point metal is disclosed. The apparatus includes a melting furnace main body (5) forming a combustion chamber (6) surrounded by a refractory lining, a crucible (1) formed with a tapping orifice (2) at an appropriate position of a body and housed at the center portion of said combustion chamber, a burner (8) provided on a side wall portion of said melting furnace main body (5) for heating said crucible (1) in said combustion chamber (6) and a receptacle (6, 13) for receiving a melt flowing out through said tapping orifice (2) of said crucible (1). In the continuous melting apparatus, with employing a melting method of burner heating type which is inexpensive, easy to handle and maintenance, with successfully minimizing oxidation loss which was the shortcoming of the burner type. Also, generation of corundum on the furnace wall surface due to reaction of the aluminum melt and the furnace wall can be successfully avoided.

14 Claims, 19 Drawing Sheets

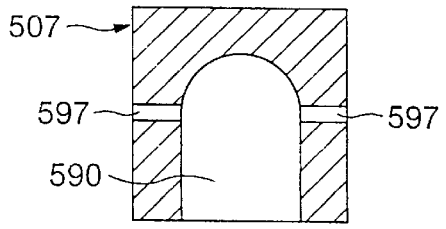
FIG. 12 (a)
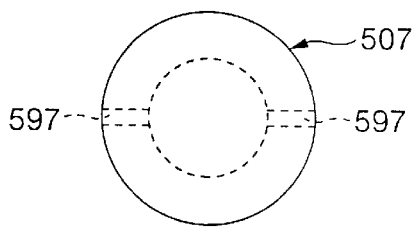
FIG. 12 (a1)
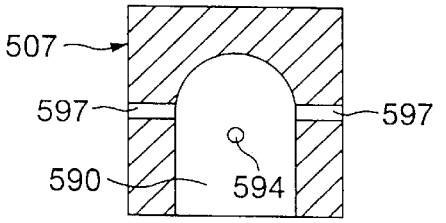
FIG. 12 (b)
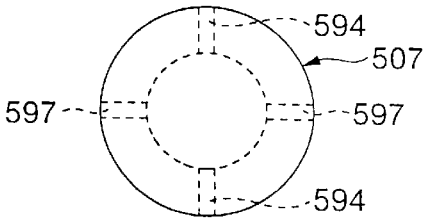
FIG. 12 (b1)
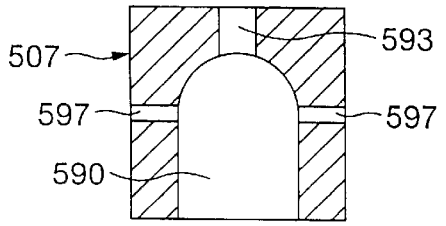
FIG. 12 (c)
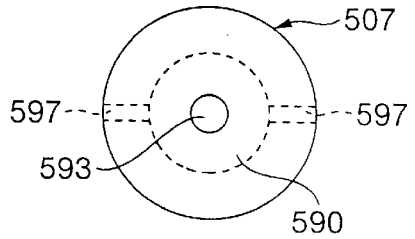
FIG. 12 (c1)
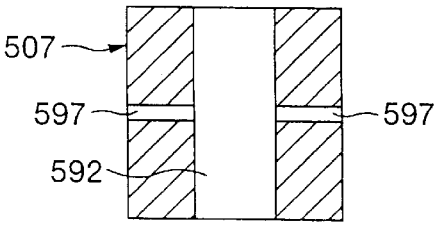
FIG. 12 (d)
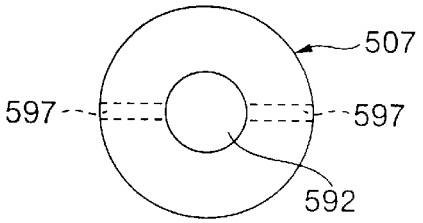
FIG. 12 (d1)
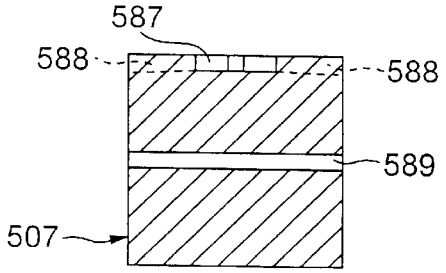
FIG. 12 (e)
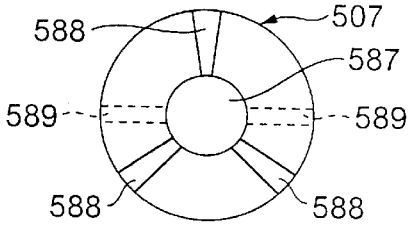
FIG. 12 (e1)

CONTINUOUS MELTING APPARATUS FOR LOW-MELTING POINT METAL, IMPROVED CRUCIBLE FOR SUCH APPARATUS, AND MELTING METHOD USING SUCH APPARATUS

BACKGROUND OF THE INVENTION

1. Field of the Invention

The present invention relates to an apparatus for continuously melting low-melting point metal, such as aluminum scrap, aluminum ingot and the like. More specifically, the invention relates to a continuous melting apparatus having a construction based on a crucible furnace. The present invention also relates to an improved crucible for such apparatus. Furthermore, the invention relates to a melting method to be employed in the apparatus.

2. Description of the Related Art

Collected empty cans of aluminum are cut into appropriate size of small pieces and then molten to be recycles as regenerated ingot. Aluminum scraps, such as clippage, chips and the like disposed from factories and the like are similarly molten to form regenerated ingot. Scrap, such as copper or the like can also be recycled, similarly. In order to promote such recycling, it has been strongly demanded to operate a facility of melting apparatus at quite low cost so as to be easily implemented even by quite small scale business establishment, autonomous body and the like.

In large scale die-casting factory, molten metal such as aluminum molten by a concentrated melting furnace, is received by a heat resistive vessel, such as that called as a ladle to distribute for holding furnace as auxiliary facility of various casting facility in the factory. If large amount of ingot is molten everyday for distributing to various place in wide factory, such system should be reasonable.

However, in small scale recycling factory or die-casting factory, where amount to be handled is not so large and handling amount fluctuates significantly in day-by-day, the large scale concentrated melting furnace is inappropriate in various reasons, but rather a compact and inexpensive apparatus which is easy to handle and facilitates maintenance would be more appropriate. Particularly, instead of batch process, in which operation for melting the certain amount of material and operation for taking the melt from the furnace are repeated, functionality to continuously perform melting operation by continuously supplying the scrap and ingot one after another is necessary by all means. It is also desired to have practicality to maintain the melt at an appropriate temperature with continuously melting the material and to easily draw the melt as required.

In the prior art, as conventional continuously melting and holding apparatus which can be adapted to the needs set forth above has been disclosed in Japanese Examined Patent Publication No. Showa 56-17586 (hereinafter referred to as first prior art) and Japanese Examined Patent Publication No. Showa 62-23234 (hereinafter referred to as prior art 2), typically.

The apparatus disclosed in the first prior art is constructed with a cylindrical melting furnace and a holding furnace. An upper end opening of the melting furnace is a charge opening for the material, and the floor of the melting furnace is inclined down to the holding furnace to form a runner channel. Flame is blown into the furnace from a burner on a lower side wall of the melting furnace to heat the material in the furnace for melting. The melt flows from the floor of the melting furnace to the holding furnace to be accumulated in the holding furnace. In the holding furnace, a dedicated burner is provided to heat the meniscus of the accumulated melt to maintain in the molten condition.

On the other hand, in the apparatus disclosed in the second prior art, a material charge opening, a pre-heating chamber, a melting chamber, a holding chamber, and a drawing out chamber are formed integrally with a refractory material. Flame of melting burner is blown into the pre-heating chamber and the melting chamber. Then, the material in the pre-heating chamber is heated and molten. Melt flows from the pre-heating chamber to the melting chamber and then to the holding chamber to be accumulated in the holding chamber and the drawing out chamber. A dedicated burner is provided in the holding chamber to heat the meniscus of the accumulated melt for heating to maintain the molten state. The holding chamber and the drawing out chamber are communicated with each other at the lower portions thereof so that the same level of melt can be accumulated in the drawing out chamber. In a ceiling portion of the drawing out chamber, a drawing out opening with a lid is opened for permitting drawing out of the melt. In the type where flame of burner directly act on the aluminum scrap, ingot or the like to melting, as in the first and second prior art, it encounters a drawback of increased loss due to oxidation can be caused. Particularly, in case of the aluminum scrap cut into small pieces, they tend to be subjected to a combustion flame within the furnace and be oxidized to degrade melting yield significantly. Also, hydrogen gas may be absorbed in the melt to cause degradation of quality of the melt.

Also, in the cases of apparatus like those in the first and second prior art, ceramic boards, heat insulation boards or light weight porous heat insulating bricks are fitted on the outside as a material for forming furnace wall of cylindrical melting furnaces, holding furnaces or integrated type composite furnaces. And additionally placed are refractory and heat insulative Chamotte bricks. On the portion to directly contact with the melt, high alumina brick is frequently used. To joint the refractory pieces, refractory mortar homogenous with the brick is used blended with water. In such typical construction of furnace, reaction can be caused between the furnace wall material and the aluminum melt to grow corundum agglomerate on the lining wall. Such corundum agglomerate has quite high hardness to cause difficulty in removal. If attempt is made to remove the corundum agglomerate by force, a part of the lining should be damaged simultaneously. If it happens, there is no way but to exchange overall furnace to require huge amount of cost. On the other hand, if such corundum agglomerate is admixed in the melt to be caused, it should be a cause of defective products. Therefore, reduction of the corundum agglomerate is important for improving yield of products. However, as long as the general refractory is used as the furnace wall, trouble due to corundum agglomerate is inevitable.

SUMMARY OF THE INVENTION

The present invention has been worked out in view of the problems set forth above. It is an object of the present invention to provide a continuous melting and holding apparatus of low melting point metal which satisfies the following items (a) to (e):

(a) implemented in compact and in expensive and easy to handle or to perform maintenance;

(b) capable of continuously melting aluminum scrap, or ingot charge one after another;

(c) capable of holding the continuously molten melt at an appropriate temperature and easily drawing out the melt as required;

(d) loss due to oxidation is very little and admixted amount of hydrogen in the melt is also very little because the material, such as aluminum scrap or ingot, is not directly subjected to the flame of the burner; and (e) corundum agglomerate due to reaction of the aluminum melt and a furnace wall material is prevented.

The present invention is basically directed to a continuous melting apparatus for a low melting point metal, developed from crucible furnaces and comprises:

a melting furnace main body forming a combustion chamber surrounded by a refractory lining;

a crucible formed with a tapping orifice at an appropriate position of a body and housed at the center portion of the combustion chamber;

a burner provided on a side wall portion of the melting furnace main body for heating the crucible in the combustion chamber; and a receptacle for receiving a melt flowing out through the tapping orifice of the crucible.

It is preferred to implement the invention with appropriately adding the following elements to the basic construction set forth above.

(1) A crucible base is set on a floor of the combustion chamber, and the crucible is mounted on the crucible base.

(2) In the aspect of (1), the floor portion of combustion chamber serves as a first receptacle vessel for accumulating the melt flowing through the tapping orifice, and the first receptacle vessel is communicated with a second receptacle vessel located outside of the combustion chamber. In this case, the second receptacle vessel is provided with a holding heater for heating the melt received therein.

(3) A trough is connected at outside of the tapping orifice of the crucible and the melt flowing out through the tapping orifice is guided to the receptacle located out of the combustion chamber by means of the trough.

(4) In the aspect of (3), the receptacle comprises a holding furnace body forming a heating chamber surrounding by a refractory lining, a holding crucible provided at the center portion of the heating chamber, and a holding heater provided on the side wall portion of the holding furnace main body and heating the holding crucible.

(5) In the aspect of (3), a plurality of the receptacles are provided, and the trough is constructed to distribute the melt flowing out through the tapping orifice to respective of a plurality of receptacles.

(6) A baffle plate is arranged inside with an appropriate distance to the entrance of the tapping orifice. Alternatively, an opened pipe 51 downwardly extending from the tapping orifice is located in the crucible. Further alternatively, an upwardly direction gutter 52 is connected at outside of the tapping orifice. They are provided in order to prevent the slag from flowing from the crucible.

(7) A slag discharging window is formed in the body portion of the crucible at a position of different orientation relative to the tapping orifice, with lower edge located at near level to the tapping orifice and being elongated in the width direction, and a working opening for discharging slag is formed on the side wall portion of the melting furnace main body at a position spatially continuous to the slag discharging window.

(8) In the aspect of (1), an air flow hole is formed to extend laterally in the crucible base.

On the other hand, in the present invention, in order to construct the foregoing continuous melting apparatus, there has been developed a crucible as an upwardly opened refractory vessel comprises:

a tapping orifice formed through a body portion at an appropriate lower position than the upper edge of the vessel;

a blocking member provided at the portion of the tapping orifice and preventing the slag from flowing out through the tapping orifice; and a slag discharging window formed through the body portion at a position of different orientation relative to the tapping orifice, having a lower edge at near level to the entrance of the tapping orifice, and being elongated in the width direction.

In the crucible as set forth above, it is preferred that the slag discharging window is defined by a recessed cut-out reaching the upper end thereof to the upper edge of the vessel. Also, a gutter may be integrally connected to the outside of the slag discharging window, the gutter may be provided an ascending inclination from the lower edge of the slag discharging opening.

Also, in the present invention, as a method for melting and separating aluminum from a material containing aluminum and other metal having higher melting point, employing a continuous melting apparatus set forth above, wherein an appropriate amount of material is additionally charged to the crucible at appropriate timings so as to maintain non-molten aluminum in an aluminum melt in the crucible, has been developed.

BRIEF DESCRIPTION OF THE DRAWINGS

The present invention will be understood more fully from the detailed description given hereinafter and from the accompanying drawings of the preferred embodiment of the present invention, which, however, should not be taken to be limitative to be present invention, but are for explanation and understanding only.

In the drawings:

FIGS. 12(*a*) 12(*b*) 12(*c*) 12(*d*) and 12(*e*) are sections showing an example of improvement of a crucible base, to which the apparatus of the present invention;

DESCRIPTION OF THE PREFERRED EMBODIMENT

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to avoid unnecessary obscure the present invention.

A Series of Embodiments of First Type

Figure 1:
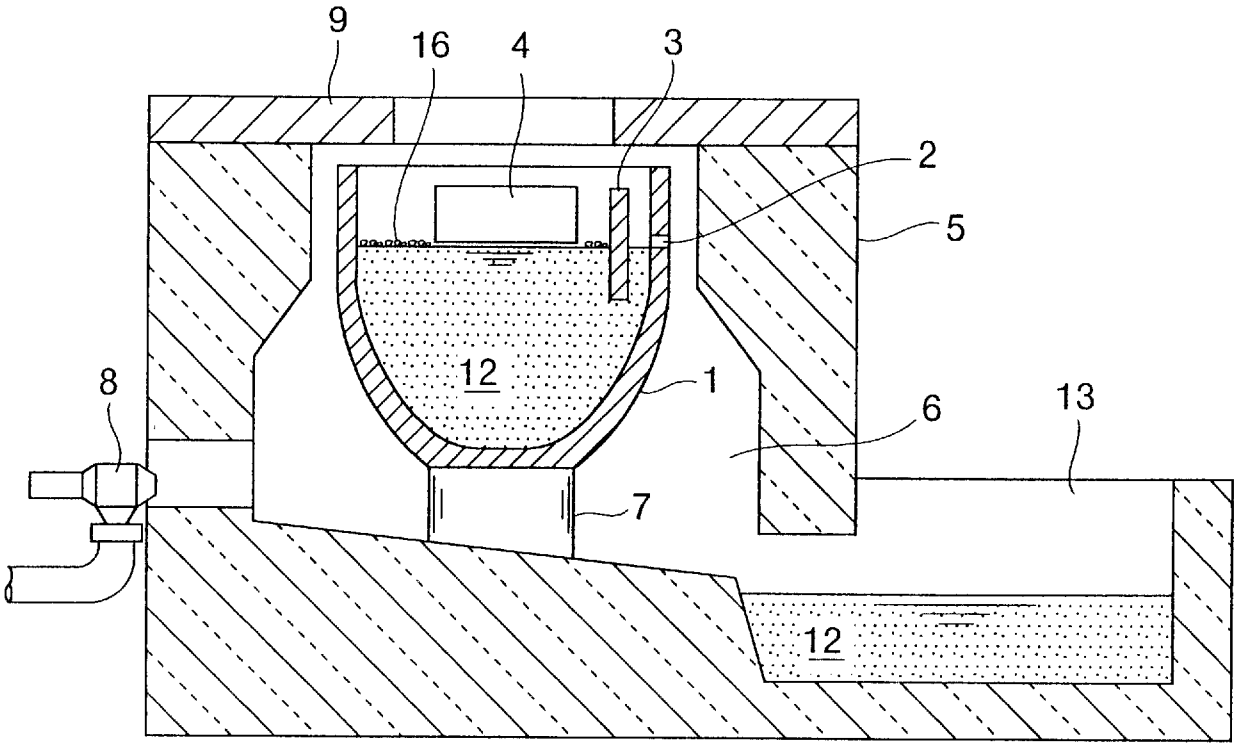
FIG. 1 is a longitudinal section of the first embodiment of a continuous melting apparatus according to the present invention.
Figure 2:
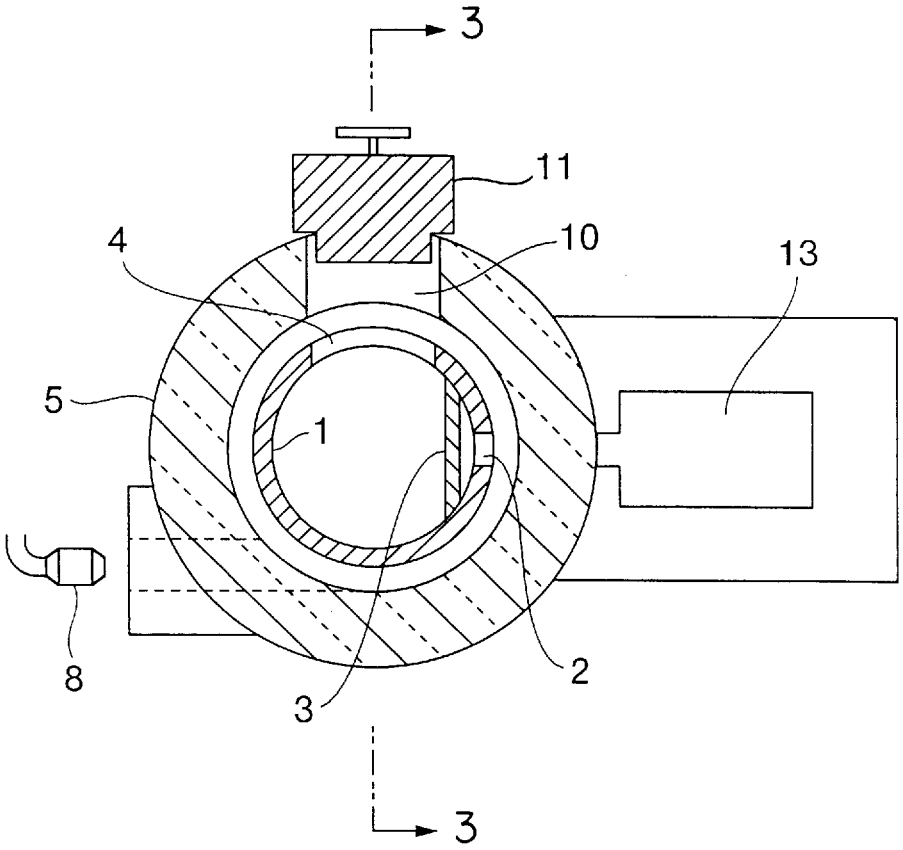
FIG. 2 is a cross section of the apparatus of FIG. 1.
Figure 3:
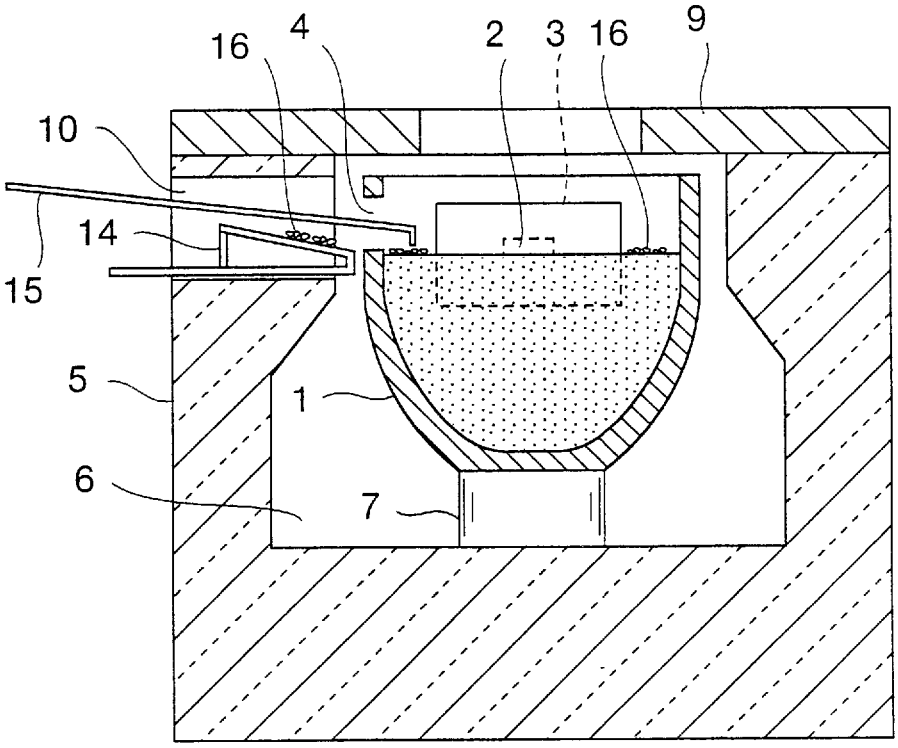
FIG. 3 is a longitudinal section of the apparatus shown in FIG. 1 as taken along line 3—3 of FIG. 2.

Construction of one embodiment of a crucible and a crucible furnace according the present invention is shown in FIGS. 1, 2 and 3. At first, discussion will be given for a construction of a crucible 1 alone. The crucible 1 is formed of graphite, graphite/silicon carbide or graphite/clay and into a bowl shaped configuration with a large opening at the upper portion and a flat bottom for self-supporting. A body of the crucible 1 is formed with a tap orifice 2 at a position below the opening end with an appropriate distance. The tap orifice 2 is a rectangular shape elongated in the width direction but has relatively small dimension.

As a blocking member for preventing slag from being discharged through the tap orifice 2, the shown embodiment employs a baffle plate 3. The body of the crucible 1 has substantially cylindrical surface. On the inside of the body at the position where the tap orifice is formed, the baffle plate 3 of graphite crucible material is formed integrally. Both side portions of the baffle plate 3 are connected to the body portion, but remaining portion thereof is placed away from the inner surface of the body portion. Particularly, at the position of the tap orifice 2, the distance between the baffle plate 3 and the body portion becomes maximum.

Figure 4:
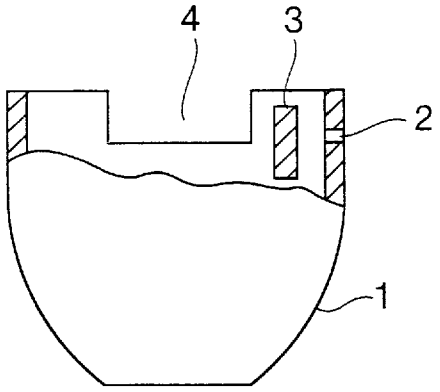
FIG. 4 is a partially sectioned front elevation showing a modification of a slug discharge window in the apparatus of FIG. 1.

As shown in plan construction of FIG. 2, viewed from the center of the crucible 1, a slag discharge window 4 is formed through the body portion at a position with 90° of angular offset from the tap orifice 2. The slag discharge window 4 has a rectangular shape elongated in the width direction. The dimension of the slag discharge window 4 is much greater than that of the tap orifice 2. The position of the lower edge of the slag discharge window 4 is set at slightly higher position than the position of the lower edge of the tap orifice 2. It should be noted that, as in the embodiment illustrated in FIG. 4, when the slag discharge window 4 is constructed to reach the upper edge thereof to the upper edge of the crucible 1, the slag discharge window 4 means a recessed cut-out. With such construction, production of the crucible may be facilitated.

Next, discussion will be given with respect to the crucible furnace. At the center of a combustion chamber 6 surrounded by a refractory lining of a furnace body, a crucible base 7 is set. On the crucible base 7, the crucible 1 constructed as set forth above is mounted. By means of a burner 8 provided through holes in the side wall portion of the furnace body 5, the crucible base 7 and the crucible 1 in the combustion chamber 6 is heated. In a furnace door 9 at the upper portion of the furnace body 5, a material charge opening is provided. A diameter of the material charge opening is smaller than the diameter of the crucible 1. The crucible 1 is located right below the charge opening. Through this charge opening, aluminum scrap and so forth is charged into the crucible 1.

On the other hand, as shown in FIGS. 2 and 3, when the crucible 1 is correctly set at a predetermined orientation in the combustion chamber 6, a working opening 10 for taking out the slag, formed in the side wall portion of the furnace body 5 and the slag discharge window 4 becomes consistent so that both are connected spatially. During other than slag discharging work, the working opening 10 is closed by a door 11.

On the other hand, a floor of the combustion chamber 6 is provided a descending slope toward the side opposite to the position of the burner 8. On the lower most portion of the floor, a hole to be a runner channel extended externally is formed. The runner channel is communicated with a holding chamber 13 of a melt 12. Next, as discussed in detail, the melt to be discharged from the tap orifice 2 of the crucible 1 flows down into the combustion chamber 6 to flow along the inclination of the floor to be accumulated in the holding chamber 13. Namely, the floor portion of the combustion chamber 6 serves as a first receptacle vessel to receive the melt flowing out through the tap orifice 2. The first receptacle vessel is communicated with the holding chamber 13 as a second receptacle vessel.

Discussion will be given with respect to use method and operation of the crucible and the crucible furnace constructed as set forth above.

Aluminum material, such as aluminum empty can appropriately cut into small pieces, is charged into the crucible 1 through a charge opening of the furnace door 9, and then the crucible 1 is heated by the burner 8. By this heat, the aluminum material is molten in the crucible 1. A combustion gas is discharged through a gap between the furnace door 9 and the crucible 1. It should be noted that, in order to promote melting of the aluminum material, the aluminum material and the melt may be stirred by a stirrer.

Since the tap orifice 2 is located at the intermediate position at an appropriate height of the body portion of the crucible 1, when a certain amount of melt is accumulated within the crucible 1, the melt flows out through the tap orifice 2 to the combustion chamber 6 to flow into the holding chamber 13. Thus the melt is accumulated in the holding chamber 13. While not illustrated, in order to prevent cooling of the aluminum melt in the holding chamber 13, it is desirable to heat the melt 12 from the above by setting an auxiliary burner in the furnace body 5.

As set forth above, aluminum melt at an amount corresponding to the position of the tap orifice 2 is accumulated in the crucible 1. Therefore, the aluminum material charged from the above contacts with the melt and is efficiently melted. Depending upon melting speed within the crucible 1. aluminum material is sequentially charged into the crucible 1 to perform continuous melting process that is different from the batch process performed by conventional crucible furnaces. Furthermore, by effectively using the heat discharged from the charge opening of the furnace door 9, the aluminum material is effectively pre-heated by the process up to sink in the melt in the crucible so that deposition, such as moisture or oil resides on the aluminum material, such deposition can be removed while passing through the pre-heating zone. Thus, possibility of causing strong reaction, such as phreatic explosion is reduced to achieve high safety. Additionally advantageously, the pre-heating zone comes to have non-oxidative atmosphere which leads to very little oxidation loss.

Figure 5A:
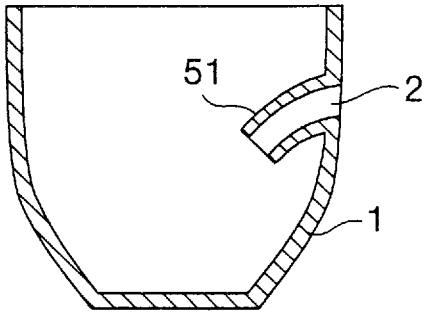
FIGS. 5(*a*) and 5*b* are sections diagrammatically showing a modification of a blocking member provided in the vicinity of a tap orifice of a crucible of the apparatus in FIG. 1.
Figure 5B:
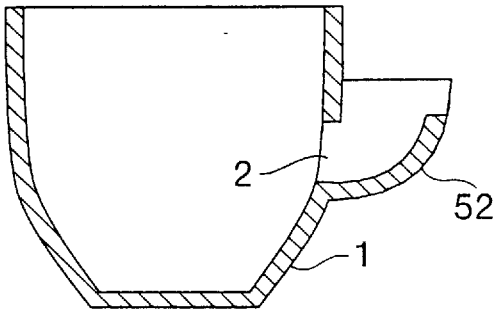

On the other hand, the construction where the baffle plate 3 is provided on the inner surface of the tap orifice 2 to shield the tap orifice 2 slightly distanced away therefrom so that the tap orifice 2 may not be blocked by the aluminum material charged in the crucible 1. About the surface of the melt, the slags are floating with aluminum material not yet melted or with sherbet form aluminum material. If these flows together with the melt into the tap orifice 2 to block the tap orifice 2, meniscus of the melt is elevated to cause the melt admixed with the slags to flow over through the large opening of the slag discharge window 4. The member to prevent this is the baffle plate 3 as the blocking member. It should be noted that the embodiment of the blocking member is not limited to the baffle plate 3. For example, as shown in FIG. 5(*a*), the opened pipe 51 (this is the blocking member) downwardly extending from the tap orifice 2 may be provided in the crucible. Or for example, as shown in FIG. 5(*b*), it is also possible to mount a gutter 52 as the blocking member is provided upwardly at the position outside of the tap orifice 2.

When a large amount of the slag is accumulated about the surface of the melt in the crucible, the working opening 10 is opened by opening the door 11 at the side portion of the furnace body 5 to perform discharging operation of the slag about the surface of the melt through the slag discharge window 4. Since the working opening 10 is located on the side surface of the furnace body, the worker is not subjected to extreme heat, even if the slag discharge operation is performed manually.

The slag discharging operation is performed in the following manner. The meniscus of the melt is positioned at slightly lower level than the lower edge of the slag discharge window 4 of the crucible 1. The slag 16 accumulates about the meniscus. Therefore, as shown in FIG. 3, by inserting a slag receptacle 14 in dustpan like form through the working opening 10, and a slag sweeper 15 with a long rod is inserted into the crucible to sweep and collect the slag from the meniscus of the melt onto the slag receptacle 14. By repeating this procedure, the meniscus of the melt is cleaned.

Figure 6:
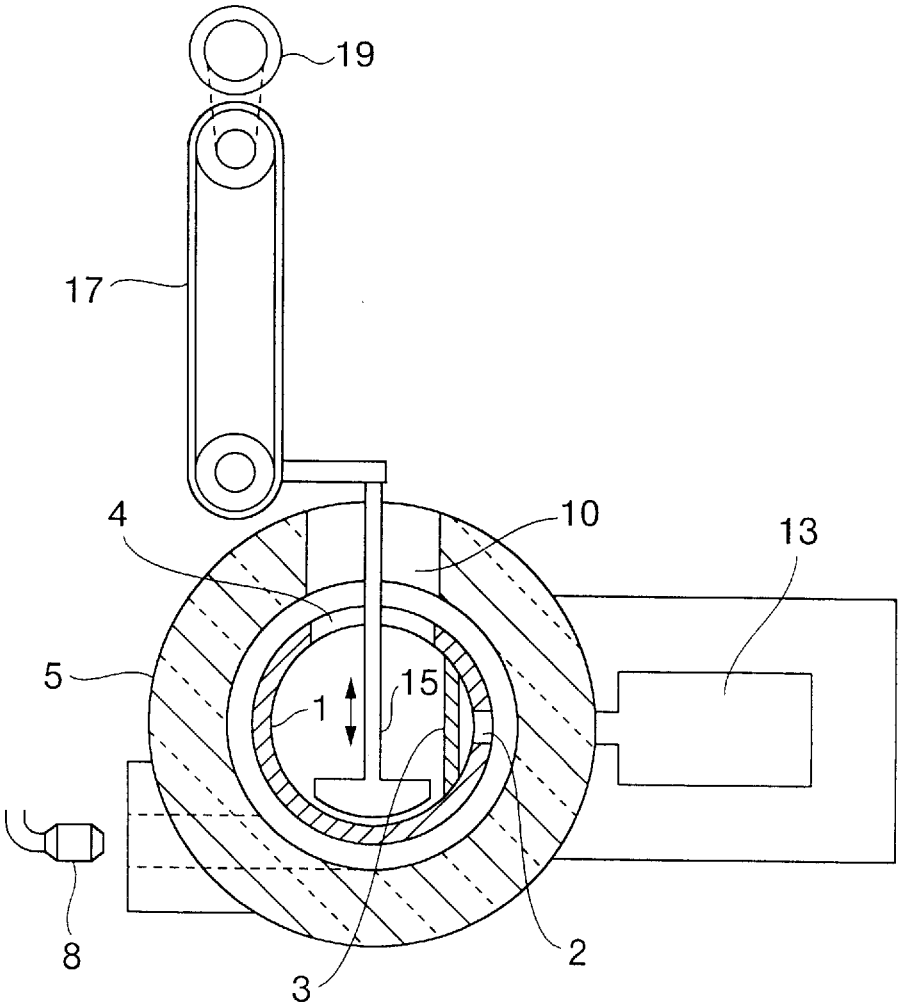
FIG. 6 is a cross section showing a slug discharge operation in the apparatus of FIG. 1.

FIG. 6 is a diagrammatic illustration showing the case where the slag sweeper 15 is mechanically reciprocated. In this example, by means of a belt mechanism driven in forward and reverse direction by a motor 19, the slag sweeper 15 is driven.

Figure 7:
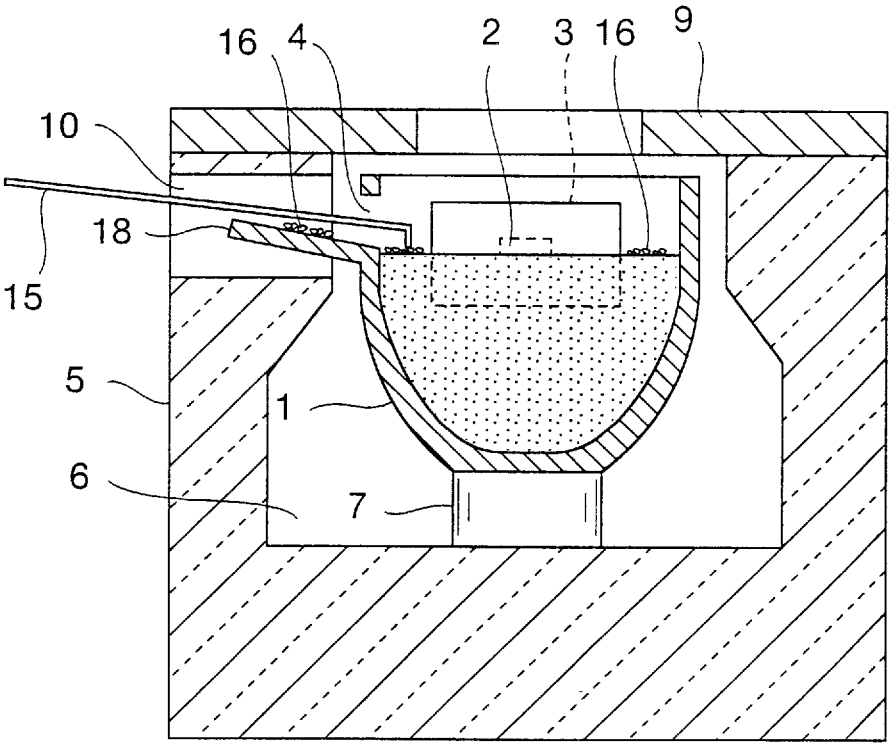
FIG. 7 is a longitudinal section of a modification of a crucible of the apparatus of FIG. 1.

Another embodiment of the crucible 1 and the crucible furnace employing the same according to the present invention is illustrated in FIG. 7. In the crucible 1 of FIG. 7, a gutter 18 is integrally connected to the outside of the portion of the slag discharge window 4. The gutter 18 is provided ascending inclination from the lower edge of the slag discharge window 4. In this embodiment, even when the charge amount of the material into the crucible 1 is abruptly increased to exceed a tapping amount through the tapping orifice 2, or even when the melt is boiled by flux process or so forth to temporarily position the meniscus of the melt at higher position than the tapping orifice 2, the slag is prevented from flowing into the combustion chamber 6 together with the melt for presence of the ascending gutter 18. Advantageously, since the gutter 18 is extending from inside the furnace as shown in FIG. 7 through the working opening 10 of the furnace body 5, operation for discharging the slag out of the furnace is easily performed.

A Series of Embodiments in Second Type

Figure 8:
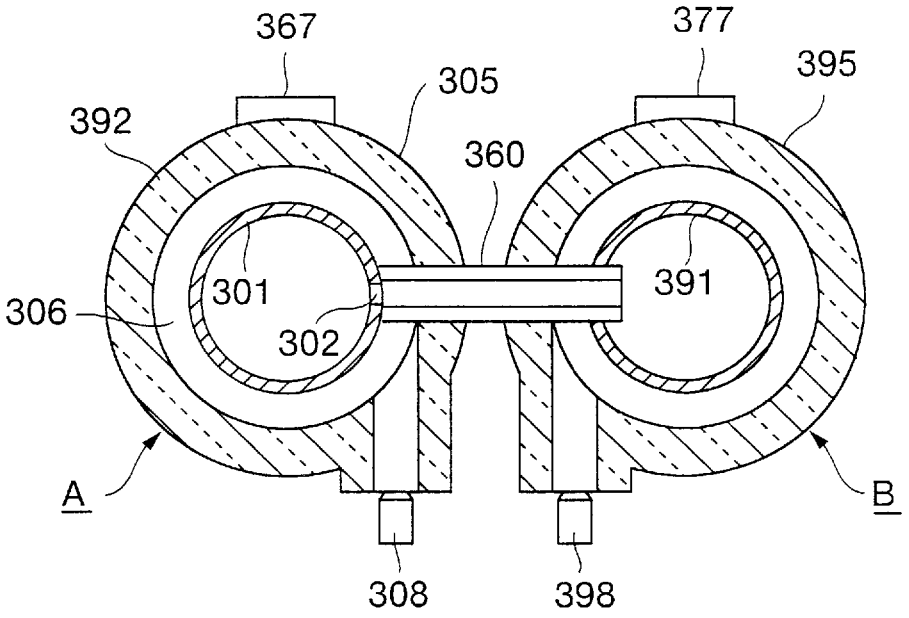
FIG. 8 is a cross section of the second embodiment of a continuous melting apparatus according to the present invention.
Figure 9:
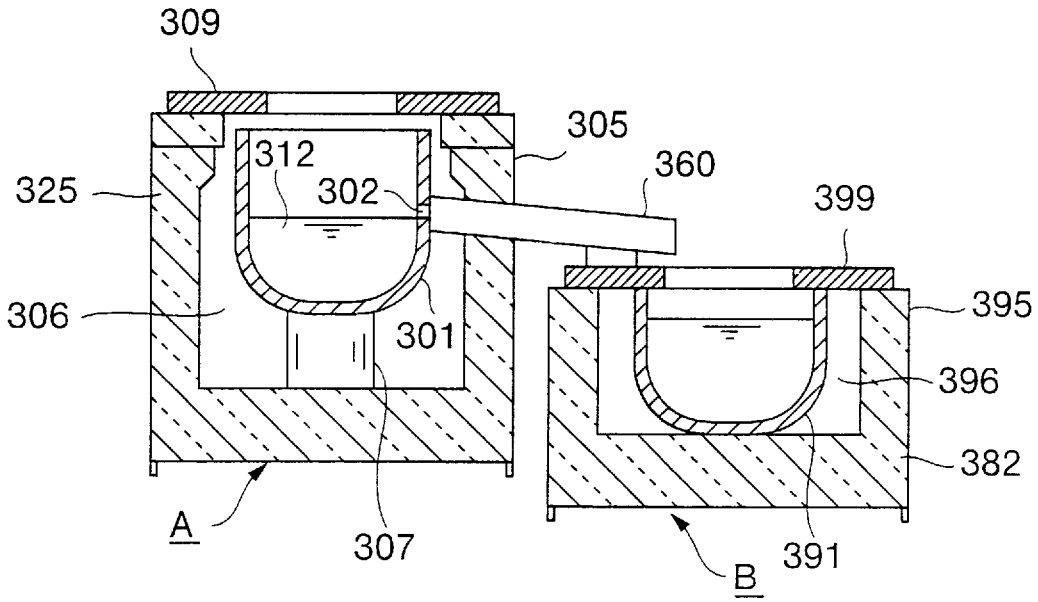
FIG. 9 is a longitudinal section of the apparatus of FIG. 8.

Embodiment of another type of the present invention is illustrated in FIGS. 8 and 9. The shown embodiment of the continuous melting apparatus is constructed with a single melting furnace A as a main body of the apparatus and a single holding furnace B as a receptacle vessel located out of the foregoing combustion chamber, The melting furnace A includes a melting furnace main body 305 forming a combustion chamber 306 surrounded by refractory lining 392, a crucible base 307 set at the center of the combustion chamber 306, a melting crucible 301 formed with a tapping orifice 302 at an intermediate height of the body portion, and a melting burner 308 provided on the side wall portion of the melting furnace main body 305 to heat the crucible 301 from the circumference. The crucible base 307 and the crucible 301 are formed of graphite, graphite/silicon carbide, or graphite/clay. On the side wall portion of the furnace main body 305, a cleaning opening 367 is formed. On the melting furnace main body 305, a donut shape furnace door 309 is placed.

The holding furnace B includes a holding furnace main body 395 forming a heating chamber 396 surrounded by a refractory lining 382, a holding crucible 391 set at the center portion of the heating chamber 395, a holding burner 398 provided on the side wall portion of the holding furnace main body 395 for heating the crucible 391 from the circumference. The crucible 391 is formed of graphite, graphite/silicon carbide, or graphite/clay. On the side wall portion of the holding furnace main body 395, a cleaning opening 377 is formed. On the holding furnace main body 395, a donut plate shape furnace door 399 is placed. It should be noted that the holding burner 398 may be replaced with other heating equipment, such as an electric heater or so forth.

A melt passage 360 connecting the melting furnace A and the holding furnace B is a sectionally channel shaped trough of graphite crucible material. The melt passage 360 is formed through the side wall of the furnace main body 305. At one end portion of the melt passage 360 is connected to the outside of the tapping orifice 302 of the melting crucible 301 in the melting furnace A. The other end of the melt passage 360 is supported above the furnace door 399 of the holding furnace B. Thus the tip end of the melt passage 360 is located in opposition to the upper opening of the holding crucible 391. The melt passage 360 has a gently descending inclination from the melting furnace A to the holding furnace B.

The material, such as aluminum scrap is continuously charged into the crucible 301 of the melting furnace A with heating by the melting burner 308. By this heat, the aluminum material in the crucible 301 is molten from the lower side. The combustion gas is discharged through a gap between the furnace door 309 and the crucible 301. It may be possible to stir the aluminum material and melt 312 by a stirrer in order to promote melting of the aluminum material. Since the tapping orifice 302 is located at the intermediate height position of the body portion of the melting crucible, when a certain amount of melt 312 is accumulated within the crucible, the melt 312 flows out through the tapping orifice 302 to flow down to the crucible 391 of the holding furnace B via the melt passage 360.

By appropriately heating the crucible 391 by the burner 398 of the holding furnace B, the melt accumulated in the crucible 391 can be maintained at appropriate temperature. The melt accumulated in the holding crucible 391 may be drawn out as required. The drawing operation and continuous melting operation in the melting furnace A can be performed in parallel without any obstruction.

As set forth above, since the aluminum melt is accumulated in the crucible in amount corresponding to the position of the tapping orifice 302, the aluminum material charged from the above may be efficiently molten with contacting with accumulated melt 312. By continuously charging the aluminum material depending upon the melting speed in the crucible 301 continuous melting process, different from the batch process as performed in conventional crucible furnaces, can be performed. On the other hand, utilizing the heat discharged from the charge opening of the furnace door 309, the aluminum material is effectively pre-heated by the process up to sink in the melt in the crucible so that deposition, such as moisture or oil resides on the aluminum material, such deposition can be removed while passing through the pre-heating zone. Thus, possibility of causing strong reaction, such as phreatic explosion is reduced to achieve high safety. On the other hand, the pre-heating zone is in non-oxidized atmosphere to have quite small oxidation loss. Also, little hydrogen may be admixed in the melt.

Figure 10:
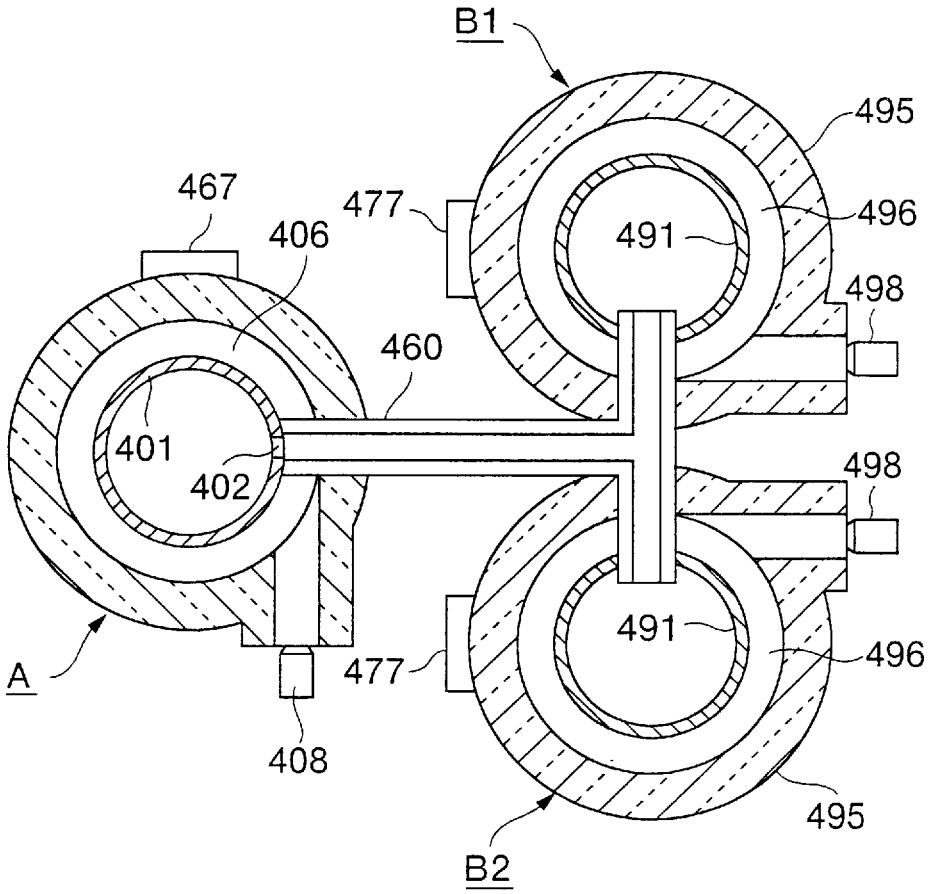
FIG. 10 is a cross section of the third embodiment of the continuous melting apparatus according to the invention.
Figure 11:
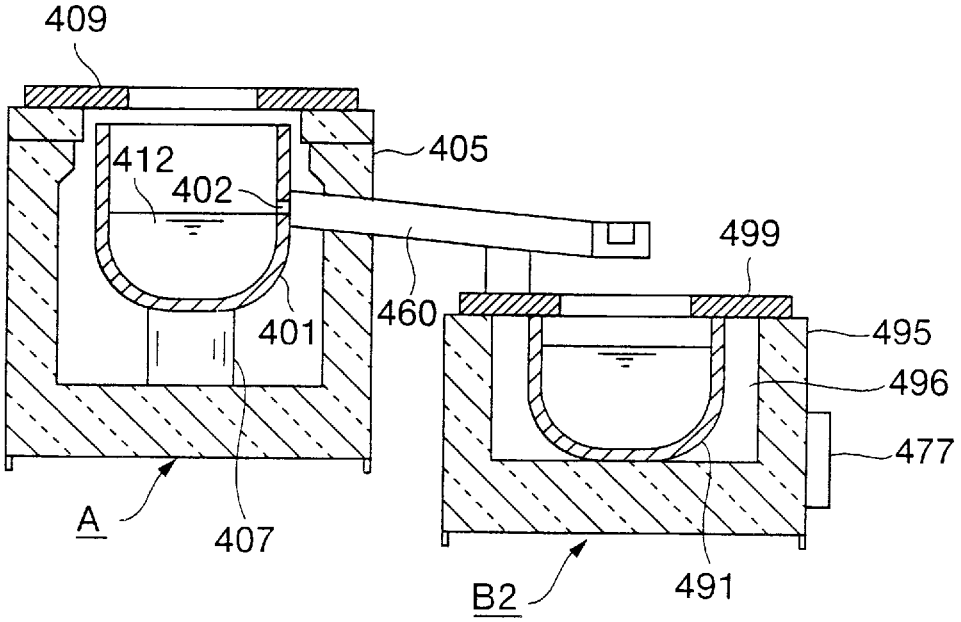
FIG. 11 is a longitudinal section of the apparatus of FIG. 10.

Another embodiment of this type is illustrated in FIGS. 10 and 11. The shown embodiment of the continuous melting apparatus is constructed with a single melting furnace A and two holding furnaces B1 and B2 arranged close proximity to each other. The construction of the melting furnace A is the same as that in the former embodiment, and the constructions of the holding furnaces B1 and B2 are substantially the same as the holding furnace B in the former embodiment.

The melt passage 460 is differentiated from the former embodiment and is constructed to connect the single melting crucible 401 and two holding crucibles 491 for distributing the melt. Specifically, the melt passage 460 is formed into T-shaped configuration so that the melt flow out from the melting crucible 401 distributingly flow into the holding crucibles 491 of the left and right holding furnaces B1 and B2. By providing a an appropriate partition at the branch portion of the melt passage 460, the melt can be selectively supplied to the holding furnaces B1 and B2. In this case, once the crucible of the holding furnace B1 is filled with the melt, the melt supply passage is switched toward the holding furnace B2 side. Then, the filled-up holding furnace B1 is moved to the position requiring the melt by a transporting means, such as a forklift or the like. Namely, the holding furnace may serve as a ladle. Thus quite reasonable working procedure can be established.

Improved Crucible Base

Next, discussion will be given for the preferred form of the crucible base in the continuous melting apparatus according to the present invention. In the continuous melting apparatus shown in FIGS. 1 or 8, with respect to an annular space between the inner peripheral wall of the combustion chamber and the outer peripheral surface of the crucible base, a flame of the burner is blown in the tangential direction The flame from the burner propagates along the floor of the combustion chamber to heat surrounding the side surface portion of the bottom surface of the crucible. Accordingly, the temperature of the crucible is elevated the temperature from the bottom side. However, in strict sense, elevation of the temperature at the center portion of the bottom of the crucible is not necessarily the fastest. Since the center of the bottom of the crucible is in contact with the crucible base to shielded from the heat of the flame by the crucible base to cause delay in elevating the temperature at the center of the bottom in comparison with the side wall of the bottom of the crucible outside portion of the crucible base. Particularly, when a refractory fiber is disposed between the crucible base and the crucible, heat shielding of the center of the bottom of the crucible becomes more significant.

By providing higher efficiency of thermal conduction for the center of the bottom of the crucible, melting speed of the metal in the crucible can be higher to save fuel. Also, since heating from the crucible base is increased to enhance degassing effect by natural convection of the melt. On the other hand, in case of the conventional crucible base of cylindrical shape, it has higher heat shielding effect to cause delay in temperature elevation in the bottom portion of the crucible.

In order to solve the problem set forth above, the improved shape of the crucible base as shown in FIGS. 12(*a*) to 12(*e*) are disclosed.

The embodiment of the crucible base 507 shown in FIG. 12(*a*) is constructed with an upper end closed cylindrical body, and two air flow holes 597. These air flow holes 597 reaches the hollow portion 590 of the inside. When this crucible base is applied for the crucible furnace shown in FIG. 1, flame or combustion gas penetrate into the hollow portion 590 through the air flow hole 597 to make speed of elevation of temperature of the crucible base 507 higher. Accordingly, the large amount of calorie is transmitted to the center of the bottom of the graphite crucible from the crucible base 507 to promote temperature elevation of the crucible bottom.

In the embodiment of the crucible base as shown in FIG. 12(*b*), in addition to the air flow hole in lateral alignment in the embodiment of FIG. 12(*a*), two air flow holes 594 intersecting in cross form are formed. Since number of the air flow passages is increased, the heat capacity of the crucible base per se decreases, and the combustion gas introduction effect can be enhanced.

The embodiment of the crucible base shown in FIG. 12(*c*) is formed with an air flow hole 593 vertically extending in the ceiling portion of the crucible base, in the construction of the embodiment shown in FIG. 12(*a*). Thus, by the combustion gas introduced into the center portion, the crucible base can be efficiently heated by the combustion gas.

The crucible base of the embodiment shown in FIG. 12(*d*) is formed with through air flow passage extending laterally in the straight cylindrical body through which the hollow portion 592 extending vertically, which corresponds to that the diameter of the air flow hole 593 shown in the embodiment of FIG. 12(*c*) is increased in the embodiment.

The crucible base of the shown FIG. 12(*e*) is formed with a air flow hole 589 extending in the lateral direction in the solid cylindrical body. On the other hand, on the upper end surface, the central recessed portion 587 and the radial recess 588 are formed. Since the air flow passage 589 is present, an effect to promote temperature elevation in the crucible base is achieved. Though this, since the radial recess 588 and the central recess portion 587 are present, the combustion gas directly promote elevation of temperature of the contact portion of the crucible base and the graphite crucible and the crucible base.

Other Embodiment

Figure 13:
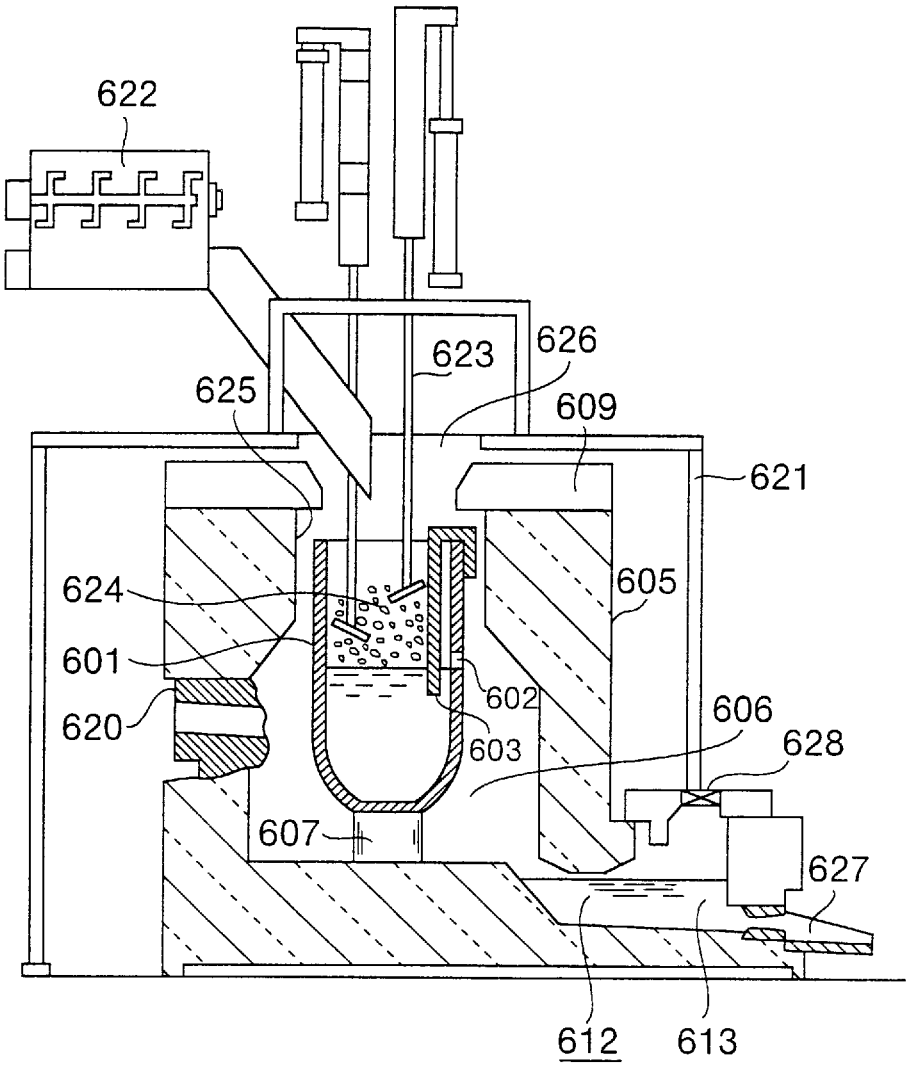
FIG. 13 is a longitudinal section of the fourth embodiment of a continuous melting apparatus according to the present invention.
Figure 14:
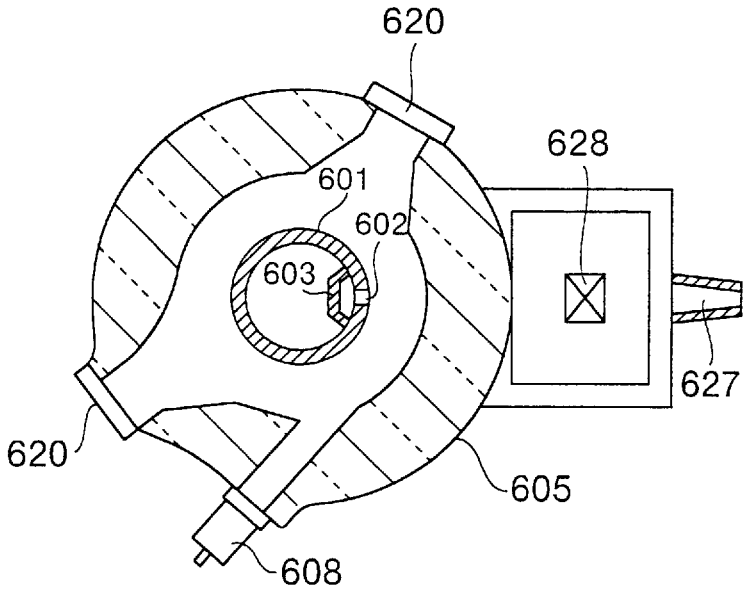
FIG. 14 is a cross section of the apparatus of FIG. 13.

The construction of other embodiments of the present invention is shown in FIGS. 13 and 14. A crucible base 607 is set at the center of the combustion chamber 606 surrounded by the refractory lining of a furnace body 605. On the crucible base 607, a graphite crucible 601 is mounted. By means of a burner 608 provided in the hole of the side wall portion of the furnace body 605, the crucible 601 and the crucible base 607 in the combustion chamber 606 is heated. At two portion of the side wall portion of the furnace body 605, cleaning openings 620 is provided at two positions. On the other hand, a table 621 extending over the upper portion of the furnace body 605 is provided. On the table 621, an aluminum charging device 622 and a stirring device 623 are mounted.

A tapping orifice 602 is formed though the intermediate height portion of the body of the crucible 601. Within the crucible 601, a baffle plate 603 is provided at the portion where the tapping orifice 602 is formed. The baffle 603 covers the tapping orifice 602 at appropriately spaced apart position from the opening surface of the tapping orifice 602. Also, the lower end of the baffle plate 603 is extended appropriately beyond the lower end position of the tapping orifice 602.

In practice, the graphite crucible is a cylindrical shape of 1100 mm height. A single tapping orifice 602 of 60 mm of height×100 mm of width is formed at substantially intermediate body portion is formed. The baffle plate 603 in the shown embodiment, is mounted by hooking on the upper edge of the crucible 601 and vertically hanged within the crucible 601. Between the surface of the baffle plate 603 and the opening surface of the tapping orifice 602, a gap in the extent of 30 mm is provided. Also, the lower end of the baffle plate 603 extends by about 80 mm lower than the lower end of the tapping orifice 602. Also, as shown in FIG. 14, both end portion of the baffle plate 603 are bent toward the wall surface of the crucible 601 so that both ends are contacted onto the inner peripheral surface of the crucible 601.

Aluminum material 624, such as aluminum scrap cut into small pieces is charged through the upper opening in the crucible 601, and is heated from the outer periphery of the crucible 601. By this heat, the aluminum material in the crucible 601 is molten from the lower portion. The combustion gas is discharged from the opening portion 626 of the furnace door 609 via a gap between the furnace door 625 and the crucible 601. In order to promote melting of the aluminum material 624, a stirring device 623 is used, in which the aluminum material 624 and the melt are mixed by stirring.

Since the tapping orifice 602 is present at substantially intermediate position of the body of the crucible 601, melt is accumulated in the crucible 601 in certain amount. Then, the melt flows out externally from the crucible 601 and accumulated in the holding chamber 613 in the furnace body 605. Within the furnace body 605, a melt passage extending from the combustion chamber 606 to the holding chamber 613 and then to a tapping trough 627, is formed. The aluminum melt 612 accumulated in the holding chamber 613 is discharged out of the furnace from the tapping trough 627 by the effect of the grammatical force. In order to prevent cooling of the aluminum melt 612 accumulated in the holding chamber 613, an auxiliary burner 628 is provided in the furnace body 605 to heat the melt 612 from above.

As set forth above, aluminum melt of the amount corresponding to the position of the tapping orifice 602 is accumulated within the crucible 601. The aluminum material 624 charged from the above is molten efficiently by contacting with the accumulated melt. The upper space from the meniscus of the aluminum melt in the crucible becomes a pre-heating zone. The charged aluminum material 624 is accumulated in the pre-heating zone and is molten into the melt from the lower portion gradually.

Figure 15:
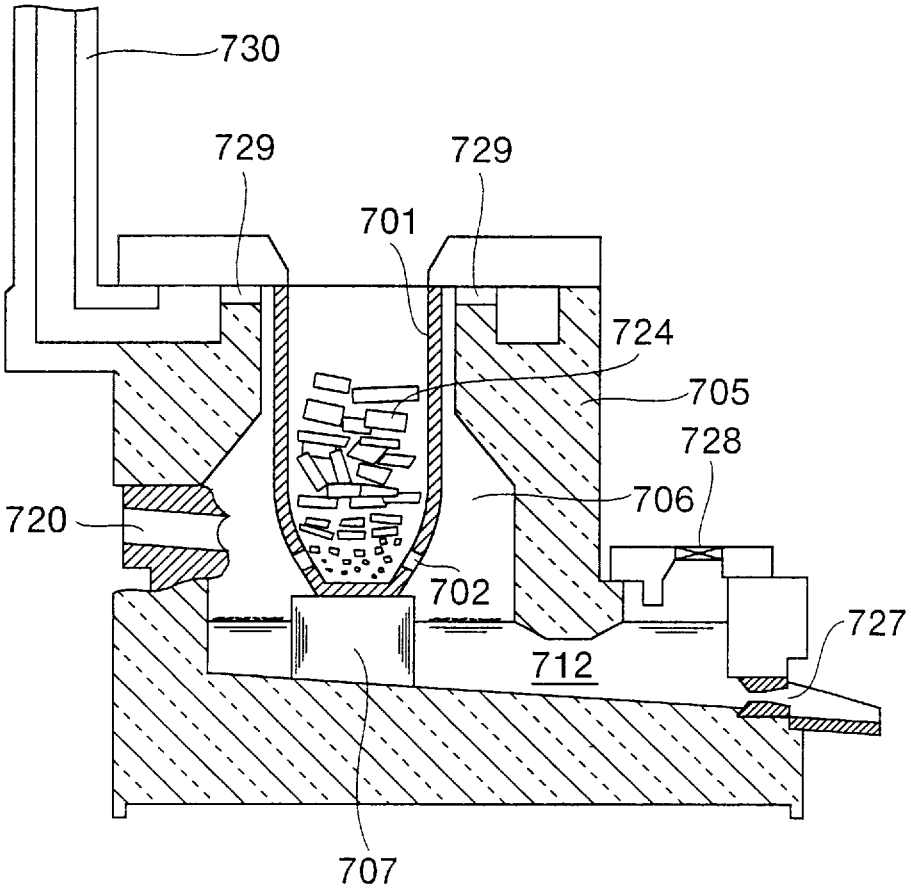
FIG. 15 is a longitudinal section of the fifth embodiment of a continuous melting apparatus according to the present invention.

On the other hand, a construction of the further embodiment is illustrated in FIG. 15. A crucible base 707 is set at the center of the combustion chamber 706 surrounded by the refractory lining of the furnace body 705. On the crucible base 707, a graphite crucible 701 is mounted. By means of a burner 708 provided in the hole of the side wall portion of the furnace body 705, the crucible 701 and the crucible base 707 in the combustion chamber 706 is heated. The uppermost space of the combustion chamber 706 is communicated with a funnel 730 via a gas duct 729. At two portion of the side wall portion of the furnace body 705, cleaning openings 720 is provided at two positions. A tapping orifice 702 is formed through the crucible in the vicinity of the bottom. In practice, of the graphite crucible 701 has cylindrical shape of the height of 1100 mm. On the peripheral surface, slightly above the bottom surface, four portions of the tapping orifices 702 of 40 mm diameter are formed. The height of the crucible base 707 is 350 mm.

Aluminum material 724 is charged from the upper opening in the crucible 701, the crucible 701 is heated from the outer periphery by the burner 708. By this heat, aluminum material 724 is molten from the lower portion in the crucible 701. In the vicinity of the bottom of the crucible 701, the tapping orifice 702 is formed. Therefore, the aluminum melt in the crucible 701 is discharged out of the crucible through the tapping orifice 702 by the action of the gravity and is accumulated in the bottom of the combustion chamber 706 of the furnace body 705.

The inner structure of the furnace body 705 formed the melt passage extending from the combustion chamber 706 to the tapping trough 727. The aluminum melt 712 accumulated in the bottom of the combustion chamber 706 is discharged out of the furnace from the tapping trough 727 by the action of gravity. In order to prevent cooling of the aluminum melt 712 in the melt passage from the combustion chamber 706 to the tapping trough 727, the furnace body 705 is heated by setting the auxiliary burner 728.

Depending upon melting speed within the crucible 701, aluminum material 724 is charged into the crucible 701 gradually so as to perform continuous melting process different from the batch process as performed by conventional crucible furnaces. The aluminum material 724 charged into the crucible 701 is not directly contacted with the melt, but gradually fall down to be molten with being heated in the upper space of the crucible 701. Namely, the space in the upper portion of the crucible serves as a pre-heating zone and the space in the lower portion serves as melting zone to progress melting. Even when deposition, such as moisture or oil on the aluminum material 7 resides, such deposition can be removed while passing through the pre-heating zone. Since not large amount of melt is present in the melting zone, possibility of causing strong reaction, such as phreatic explosion is reduced to achieve high safety. On the other hand, the pre-heating zone is in non-oxidizing atmosphere to have very little oxidation loss.

Discussion will be given for another embodiment of this type. When heat transmission to the upper space (pre-heating zone) is not efficient, it is effective to stir the aluminum material 724 by means of the stirrer 723 as in the embodiment illustrated in FIG. 16. On the other hand, in the embodiment illustrated in FIG. 17, smaller crucible 732 having smaller diameter than the crucible 701 is upwardly set at the center of the crucible 701 via a base 733. Within the smaller crucible 732, aluminum melt and a dipping heater 735 are disposed so that the aluminum material 724 in the space between the crucible and the smaller crucible.

Figure 16:
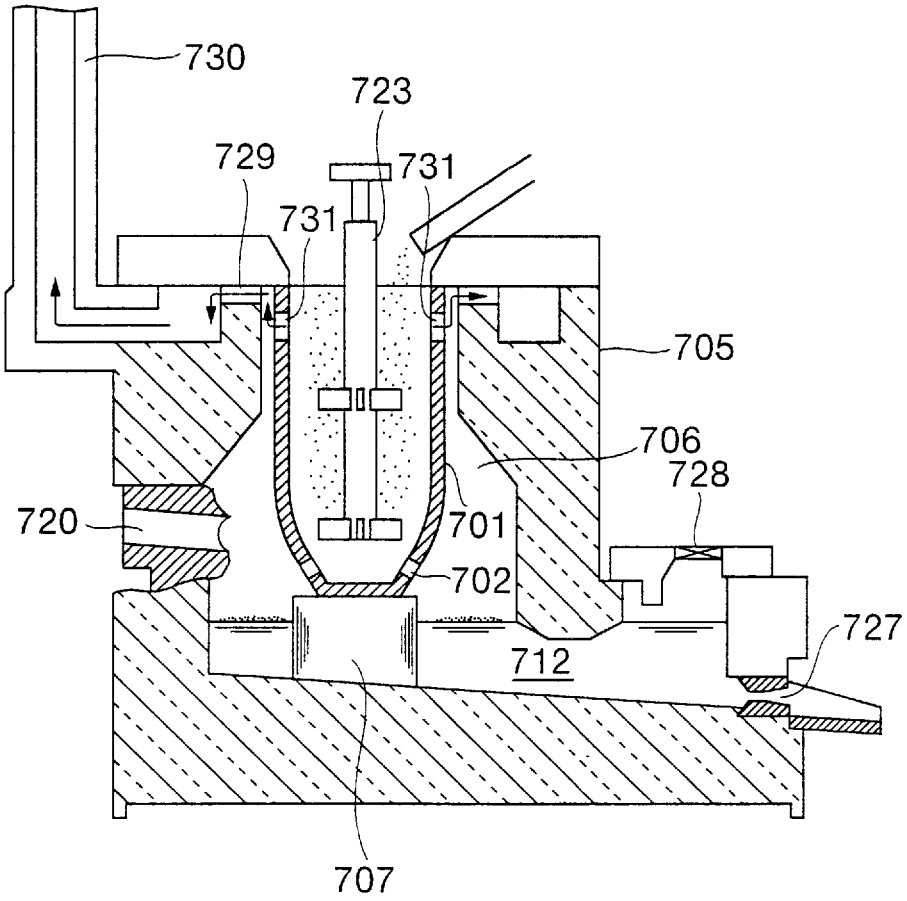
FIG. 16 is a longitudinal section including a stirring apparatus which can be installed in the apparatus of FIG. 15.
Figure 17:
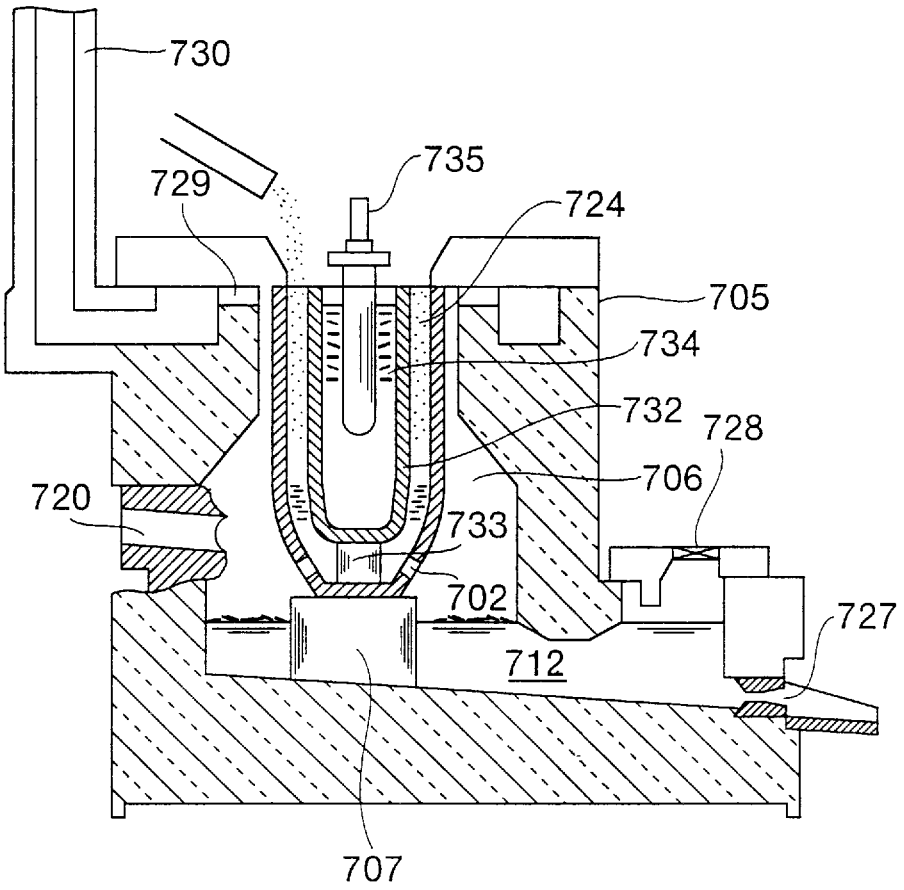
FIG. 17 is a longitudinal section of the sixth embodiment of a continuous melting apparatus according to the present invention.

In the embodiment of FIG. 16, a degassing hole 731 is formed through the upper peripheral wall of the crucible 701. The degassing hole 731 is opposed in the vicinity of the gas duct 729 connected to the funnel 730. With the construction set forth above, black smoke caused in the crucible 701 enters into the combustion chamber 706 to be mixed with the combustion gas to be discharged to the funnel 730 via the gas duct 729. Inside of the crucible 701 can thus maintained in non-oxidative atmosphere.

Figure 18:
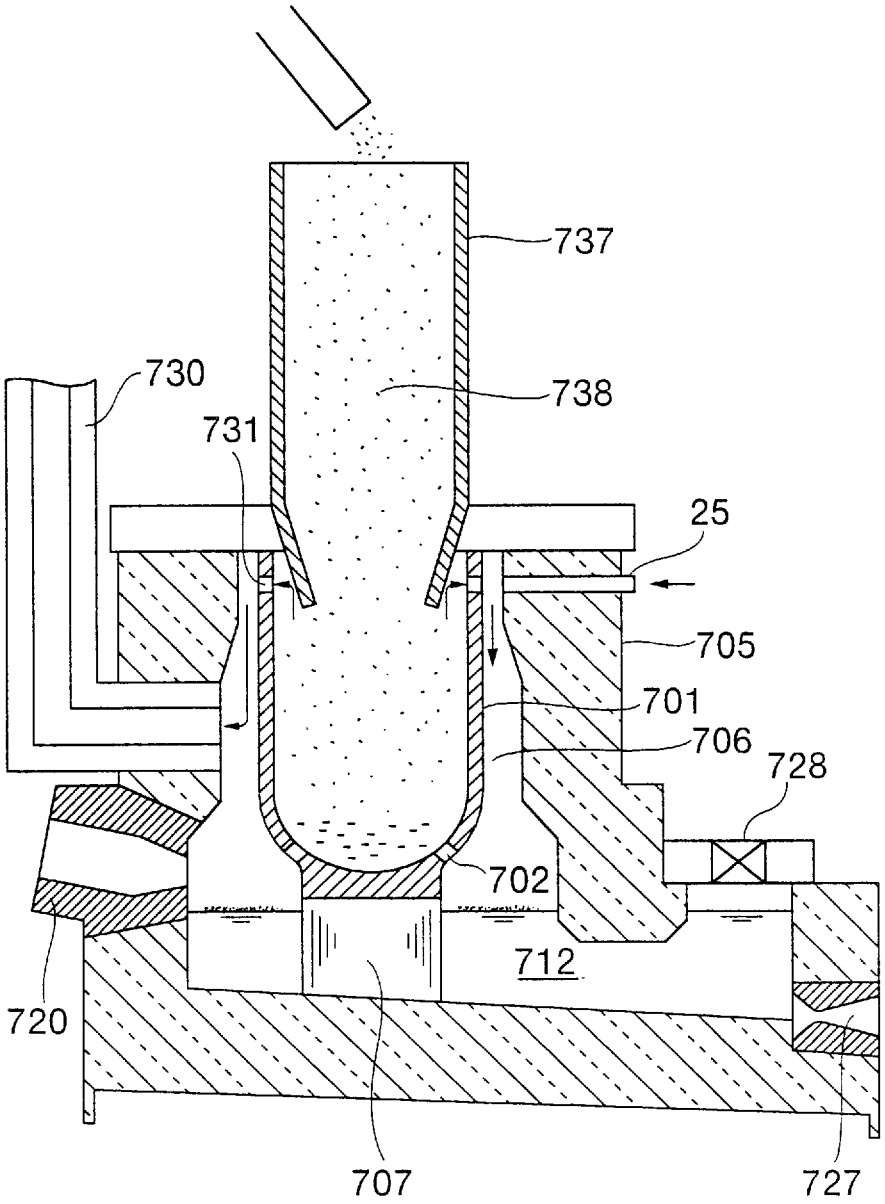
FIG. 18 is a longitudinal section of the seventh embodiment of a continuous melting apparatus according to the present invention.

On the other hand, in the embodiment of FIG. 18, an iron cylindrical pipe 737 of 1200 mm height is provided to be continuous with the upper opening of the crucible 701. With this construction, the pre-heating zone in the crucible is extended upwardly to enhance the effect of removal of the residual deposition on the aluminum material 724. Also, non-oxidation atmosphere of the pre-heating zone is more certainly established.

Figure 19:
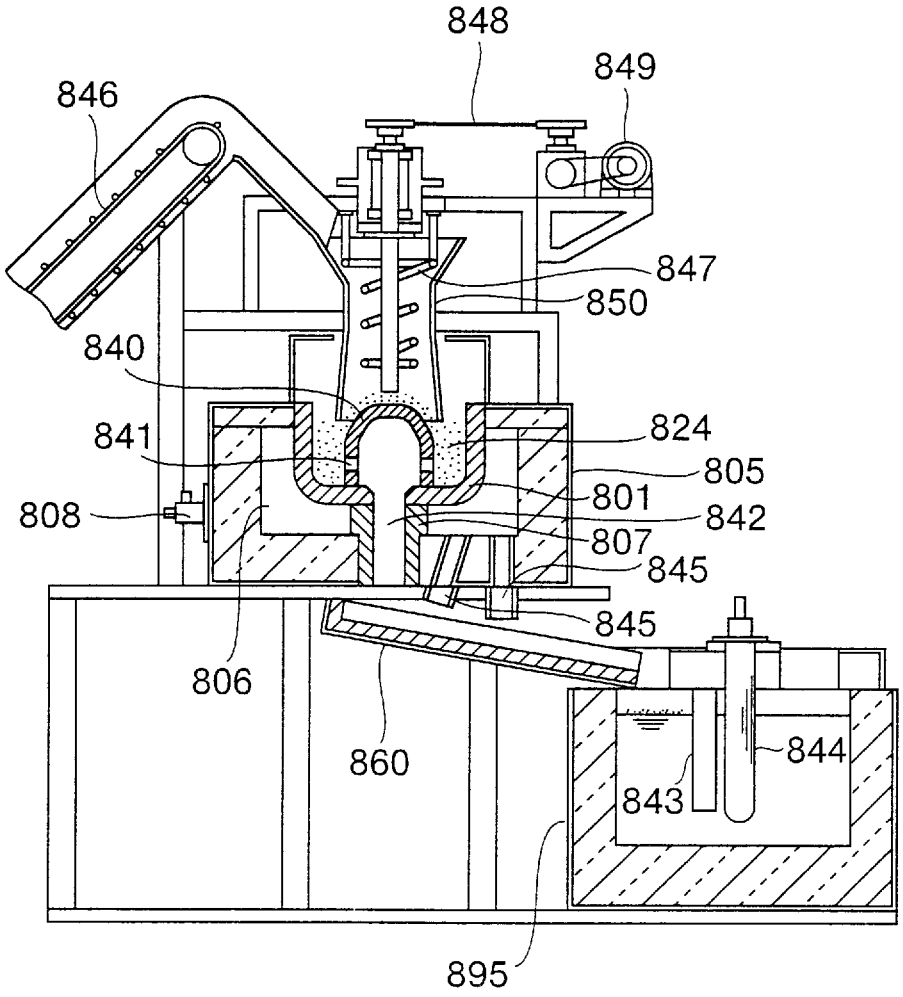
FIG. 19 is a longitudinal section of the eighth embodiment of a continuous melting apparatus according to the present invention.

An embodiment having a drawing passage of the melt different from those in the former embodiment is illustrated in FIG. 19. In this embodiment, a tapping orifice 802 (not shown) is defined at the center of the bottom of a crucible 801. In a crucible base 807, a tapping opening 842 directly communicated with the tapping orifice 802 of the crucible is defined. On the other hand, the hollow crucible base 807 per se extends through the bottom of the furnace body 805 to oppose to a trough 860 arranged below the furnace body 805. Further, a smaller crucible 840 having smaller diameter than the crucible 801 is arranged in up-side-down manner to close the tapping orifice 802 at the center of the crucible 801. A set of through holes 841 formed in the vicinity of the lower opening edge of the smaller crucible 840, serve as melt passages connecting the space defined between the crucible 801 and the smaller crucible 840 and the tapping orifice 802. Namely, aluminum melt molten in the crucible 801 flows through the through opening 841 of the smaller crucible 840 to the tapping orifice 802 at the center of the bottom of the crucible 801 to the crucible base 807 of the hollow pipe form and to the trough 860. The melt is supplied from the trough 860 to the holding furnace 895 to be accumulated therein. In the holding furnace 895, a partitioning wall 843 and a dipping heater 844 are provided. Above the trough 860, a gas duct 845 communicated with the combustion chamber 806 is provided to prevent cooling of the melt flowing through the trough 860 by the heat transmitted from the gas duct 845. It should be noted that by a work supply mechanism constituted of a conveyer 846, a screw 847, a chain 848, a motor 849 and a hopper 850, the aluminum material 824 to be molten can be charged continuously into the crucible 801.

Method for Melting and Separating Aluminum

Employing the continuous melting apparatus discussed above in detail, melting and separating operation of a material containing aluminum and metal having higher melting point, can be performed quite efficiently and rationally.

Disposed metal products, such as automotive vehicle, motor cycle, electric refrigerator and so forth are disassembled by crushing and other means, and portion which can be used are recycled as regenerated ingot. Among these metal products, there are a lot of parts, in which aluminum and iron member, copper member and so forth are integrated. These parts include many parts which are difficult to mechanically separate into respective elemental materials. Therefore, it has been performed a method to separate the elemental materials utilizing difference of melting points in aluminum, copper and so forth. However, in the conventional method, melting and separating operation cannot be performed efficiently, and temperature control in the melting furnace is difficult. This is why alloying of the aluminum and copper often happens in conventional furnaces or methods, leading to frequent failures in separation processes.

Therefore, a method according to the present invention performs melting and separating operation in the following manner. For instance, the continuous melting apparatus as illustrated in FIGS. 8 and 9 is employed. The material is assumed as a radiator in the electric refrigerator. This is a composite material in which the aluminum fin portion and copper pipe portion are integrated. Such material is hanged by wire to receive within a melting crucible 301 and then the crucible 301 is heated by the burner 308.

Melting point (660.4° C.) of the aluminum is lower than the melting point (1084.5° C.) of the copper. Therefore, aluminum fin portion in the material starts melting, at first. At this time, so as not to completely melt the aluminum fin portion, additional material is appropriately charged into the crucible 301 to progress the operation for residing certain amount of the solid aluminum material in the crucible 301. Thus, a part of the heat applied by the burner 308 is consumed as melting heat (94.8 Kcal/Kg) of the aluminum material, the temperature of the aluminum melt in the crucible 301 is maintained substantially constant at a temperature close to the melting point of the aluminum. Thus, the temperature of the aluminum metal will never becomes excessively high. Thus, failure of separation by causing alloying reaction of the aluminum and copper by melting the copper pipe portion in the material, can be successfully avoided.

Figure 20:
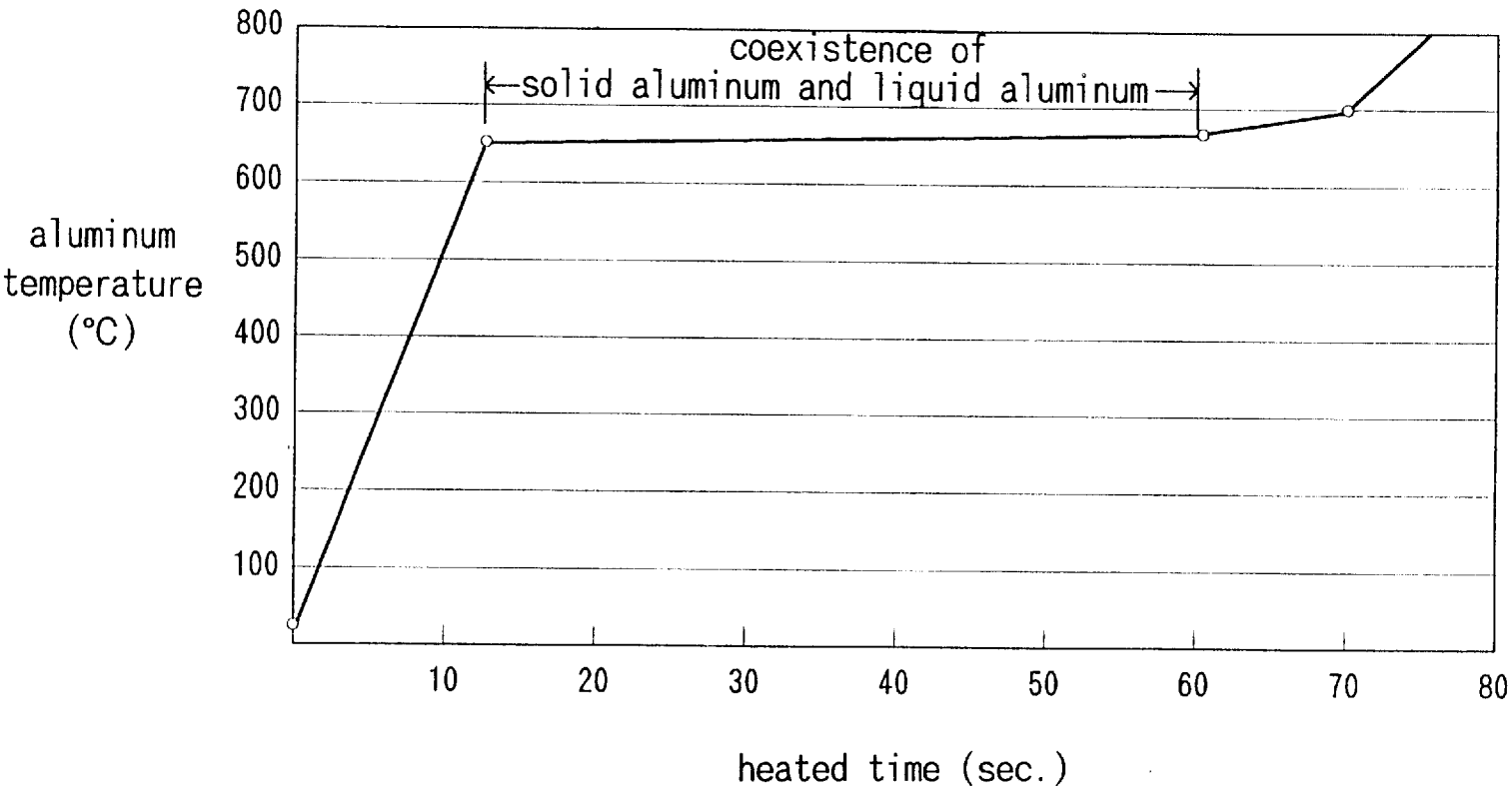
FIG. 20 is a temperature elevation curve (timing chart) in one embodiment of a continuous melting method according to the present invention.

A relationship between the temperature and a time in the crucible in the foregoing embodiment is illustrated in the graph shown in FIG. 20. For a certain period in the initial stage of heating, the temperature in the crucible is abruptly elevated. After 12.3 seconds, the elevation of the temperature slows down, and up to the 60.6 seconds, the temperature of the melt is maintained at substantially melting point. Additional material is added appropriately in order to maintain this condition. When the aluminum melt in the crucible 301 reaches the tapping orifice 302. Then, the melt flows toward the holding furnace B. As can be appreciated from the discussion given hereinabove, the present invention achieves the following effects.

(1) Melting process can be performed efficiently and continuously.

(2) Since the apparatus is based on the crucible furnace, installation space can be small, investment for facility and maintenance low, and operation cost can be low.

(3) Operation for removing the slug accumulated on the surface of the melt in the crucible is facilitated and slug removal operation can be performed without interrupting continuous melting process, and the worker may not be subject to extreme heat.

(4) Since the level of the melt in the crucible can be maintained constant, appropriate pre-heating zone can be defined above the meniscus of the melt. While the material passes through the pre-heating zone, residual deposition on the material can be effectively removed. Therefore, strong reaction, such as phreatic explosion is difficult to be caused to permit safely progress the melting operation.

(5) Since the inside of the crucible can be maintained in non-oxidizing atmosphere, oxidation loss can be quite small.

(6) Since the apparatus employs crucible furnace technologies, it can be realized compactly and at low cost. Since the melt can be received in the respective crucibles when in the melting furnace and when the holding furnace, handling becomes easier. Also, by exchanging the exhausted crucible, the apparatus can be refreshed as if a brand new apparatus. Thus, maintenance becomes quite easy.

(7) The aluminum scrap or ingot can be continuously molten with maintaining the melt at an appropriate temperature, it can achieve functionality and practicality to permit drawing out of the melt as required.

(8) Since aluminum scrap or ingot will not be directly subjected to flame of the furnace, oxidation loss becomes very small, and amount of hydrogen admixed in the melt becomes very small.

(9) Corundum agglomerate due to reaction of aluminum melt and the furnace wall material is prevented.

Although the present invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed and equivalents thereof with respect to the feature set out in the appended claims.

What is claimed is:

1. A continuous melting apparatus for a low melting point metal comprising:

a melting furnace main body forming a combustion chamber surrounded by a refractory lining;

a crucible formed with a tapping orifice at an appropriate position of a body and housed at the center portion of said combustion chamber;

a crucible base set on a floor of said combustion chamber, said crucible mounted on said crucible base;

a burner provided on a side wall portion of said melting furnace main body for heating said crucible in said combustion chamber; and a receptacle for receiving melt flowing out through said tapping orifice of said crucible, the floor portion of said combustion chamber serving as a first receptacle vessel for accumulating the melt flowing out through said tapping orifice, and said first receptacle vessel communicating with a second receptacle vessel located outside of said combustion chamber.

2. A continuous melting apparatus as set forth in claim 1 wherein said second receptacle vessel is provided with a holding heater for heating the melt received therein.

3. A continuous melting apparatus for a low melting point metal comprising:

a melting furnace main body forming a combustion chamber surrounded by a refractory lining;

a crucible formed with a tapping orifice at a substantially intermediate or higher position in said crucible body, said crucible housed at the center portion of said combustion chamber;

a burner provided on a side wall portion of said melting furnace main body for heating said crucible in said combustion chamber;

a receptacle for receiving melt flowing out through said tapping orifice of said crucible, said receptacle comprising a holding furnace main body which forms a heating chamber with a refractory lining, a holding crucible provided at the center portion of said heating chamber, and a holding heater provided on the side wall portion of said holding furnace main body to heat said holding crucible; and a trough connected at outside of said tapping orifice of said crucible wherein the melt flowing out through said tapping orifice is guided to said receptacle located out of said combustion chamber by means of said trough.

4. A continuous melting apparatus as set forth in claim 3, wherein a plurality of said receptacles are provided, and said trough is constructed to distribute the melt flowing out through said tapping orifice to respective of a plurality of receptacles.

5. A continuous melting apparatus as set forth in claim 1, wherein a baffle plate is arranged with an appropriate distance to the entrance of said tapping orifice so as to prevent slag from flowing out through said tapping orifice of said crucible.

6. A continuous melting apparatus as set forth in claim 1, wherein an opened pipe downwardly extending from said tapping orifice is located in the crucible so as to prevent slag from flowing out through said tapping orifice of said crucible.

7. A continuous melting apparatus for a low melting point metal comprising:

a melting furnace main body forming a combustion chamber surrounded by a refractory lining;

a crucible formed with a tapping orifice at an appropriate position of a body and housed at the center portion of said combustion chamber, wherein an upwardly direction gutter is connected at outside of said tapping orifice so as to prevent slag from flowing out through said tapping orifice of said crucible;

a burner provided on a side wall portion of said melting furnace main body for heating said crucible in said combustion chamber; and a receptacle for receiving melt flowing out through said tapping orifice of said crucible.

8. A continuous melting apparatus for a low melting point metal comprising:

a melting furnace main body forming a combustion chamber surrounded by a refractory lining;

a crucible formed with a tapping orifice at an appropriate position of a body and housed at the center portion of said combustion chamber;

a burner provided on a side wall portion of said melting furnace main body for heating said crucible in said combustion chamber; and a receptacle for receiving melt flowing out through said tapping orifice of said crucible, wherein a slag discharging window is formed in the body portion of said crucible at a position of different orientation relative to said tapping orifice, with lower edge located at near level to said tapping orifice and being elongated in the width direction, and a working opening for discharging slag is formed on the side wall portion of said melting furnace main body at a position spatially continuous to said slag discharging window.

9. A continuous melting apparatus as set forth in claim 1, wherein an air flow hole is formed to extend laterally in said crucible base.

10. A crucible as an upwardly opened refractory vessel comprising:

a tapping orifice formed through a body portion at an appropriate lower position of the upper edge of said vessel;

a blocking member provided at the portion of said tapping orifice and preventing slag from flowing out through said tapping orifice; and a slag discharging window formed through said body portion at a position of different orientation relative to said tapping orifice, having a lower edge at near level to said tapping opening, and being elongated in the width direction.

11. A crucible as set forth in claim 10, wherein said slag discharging window is defined by a recessed cut-out reaching the upper end thereof to the upper edge of said vessel.

12. A crucible as set forth in claim 10, wherein a gutter is integrally connected to the outside of said slag discharging window, said gutter is provided an ascending inclination from the lower edge of said slag discharging window.

13. A method for melting and separating aluminum from material containing aluminum and other metal which has a high melting point than aluminum, employing a continuous melting apparatus comprising: a melting furnace main body forming a combustion chamber surrounded by a refractory lining; a crucible formed with a tapping orifice at an appropriate position of a body and housed at the center portion of said combustion chamber; a crucible base set on a floor of said combustion chamber, said crucible mounted on said crucible base, a burner provided on a side wall portion of said melting furnace main body for heating said crucible in said combustion chamber; and a receptacle for receiving melt flowing out through said tapping orifice of said crucible, the floor portion of said combustion chamber serving as a first receptacle vessel for accumulating the melt flowing out through said tapping orifice, and said first receptacle vessel communicating with a second receptacle vessel located outside of said combustion chamber, wherein said method comprising a step of preparing aluminum melt in said crucible and at least one step of additionally charging at least some portion of said material into said crucible at an appropriate timing so as to cause and maintain a state that some non-molten aluminum is existing in said aluminum melt in said crucible.

14. A method for melting and separating aluminum from material containing aluminum and other metal which has a higher melting point than aluminum, employing a continuous melting apparatus comprising: a melting furnace main body forming a combustion chamber surrounded by a refractory lining; a crucible formed with a tapping orifice at a substantially intermediate or higher position in said crucible body, said crucible housed at the center portion of said combustion chamber; a burner provided on a side wall portion of said melting furnace main body for heating said crucible in said combustion chamber; a receptacle for receiving melt flowing out through said tapping orifice of said crucible, said receptacle comprising a holding furnace main body which forms a heating chamber with a refractory lining, a holding crucible provided at the center portion of said heating chamber, and a holding heater provided on the side wall portion of said holding furnace main body to heat said holding crucible; and a trough connected at outside of said tapping orifice of said crucible wherein the melt flowing out through said tapping orifice is guided to said receptacle located out of said combustion chamber by means of said trough, wherein said method comprising a step of preparing aluminum melt in said crucible and at least one step of additionally charging at least some portion of said material into said crucible at an appropriate timing so as to cause and maintain a state that some non-molten aluminum is existing in said aluminum melt in said crucible.

* * * * *